US006065827A

United States Patent [19]

Akiyama et al.

[11] Patent Number: 6,065,827

[45] **Date of Patent: *May 23, 2000**

[54] INK JET RECORDING METHOD AND INK JET RECORDING APPARATUS

[75] Inventors: Yuji Akiyama; Hiromitsu Hirabayashi; Shigeyasu Nagoshi; Noribumi Koitabashi; Hitoshi Sugimoto, all of Yokohama; Miyuki Fujita, Tokyo; Fumihiro Gotoh, Kawasaki; Masaya Uetuki, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/575,386

[22] Filed: Dec. 20, 1995

[30] Foreign Application Priority Data

Dec. 20, 1994 [JP] Japan ..... 6-316602

[51] Int. Cl.[7] ..... B41J 2/05

[52] U.S. Cl. ..... 347/61; 347/100; 347/105

[58] Field of Search ..... 347/54, 56, 71, 347/61, 100, 105

[56] References Cited

U.S. PATENT DOCUMENTS 5,166,699 11/1992 Yano et al. .

5,367,325 11/1994 Yano et al. ..... 347/17

5,541,633 7/1996 Winnik et al. ..... 347/98

FOREIGN PATENT DOCUMENTS 0118603 9/1984 European Pat. Off. .

0454155 10/1991 European Pat. Off. .

59-064678 4/1984 Japan .

60-197778 10/1985 Japan .

361141585 6/1986 Japan ..... 347/105

402055184 2/1990 Japan ..... 347/100

*Primary Examiner*—N. Le

*Assistant Examiner*—Anh T. N. Vo

*Attorney, Agent, or Firm*—Fitzpatrick, Cella, Harper & Scinto

[57] ABSTRACT

An ink jet recording method for recording in which an ink is discharged by the pressure of a bubble generated in the ink by means of thermal energy, having the steps of preparing an ink jet head having a liquid path provided with a heating element and communicated with a discharge opening supplying the ink into the liquid path, the ink having a surface tension equal to or less than critical surface tension of a recording medium generating thermal energy for generating a bubble with the heating element in such a manner that the bubble is communicated with the atmosphere from the discharge opening when the generated bubble has a negative internal pressure and discharging the ink from the discharge opening by means of the pressure of the bubble generated.

4 Claims, 6 Drawing Sheets

INK JET RECORDING METHOD AND INK JET RECORDING APPARATUS

BACKGROUND OF THE INVENTION

1. Field of the invention

The present invention relates to an ink jet recording method and apparatus for recording a high-quality color image on a common paper.

2. Related Background Art

In a recording apparatus such as a printer, copying machine, and facsimile device, an image is recorded on a recording medium in a sheet form, such as paper, a thin plastic sheet or the like, wherein the image is formed with dot patterns on the basis of image information.

There are several types of recording apparatus categorized on the basis of the recording method. These include ink jet, wire dot, thermal, and laser beam recording apparatus. In the ink jet recording apparatus, ink droplets are discharged toward a recording medium thereby forming an image thereon.

The ink jet recording apparatus can form a high-resolution image at a high speed. Another advantage of the ink jet recording apparatus is that it is of the non-impact type and thus it provides quiet operation. Furthermore, it is possible to easily form a color image with a plurality of color inks.

Thus, the ink jet recording apparatus, which, as described above, records an image by discharging an ink droplet according to image information via a discharge opening of an ink jet recording head toward a print medium, is advantageously used in printers, facsimile devices, copying machines, etc., especially for applications in which quiet operation is required.

In one type of ink jet recording apparatus, ink is locally heated by means of thermal energy generated by a heating element (heater) so that a bubble is generated in the ink thereby changing the pressure in a nozzle and thus discharging an ink droplet. This type of ink jet recording apparatus has an advantage that an ink droplet can be discharged at a high frequency, and thus is widely used as a recording unit in various devices.

In the ink jet recording method, the following requirements should be met.

(1) The ink does not spread after being attached to a recording medium on which an image is to be formed.

(2) The ink can be preserved without a change in quality or characteristics.

(3) The apparatus and the ink can provide high safety.

In the case of color recording, the following requirements should also be met.

(4) No mixture of color inks (bleeding) occurs between different colors disposed adjacent to each other, which can occur when ink droplets are not fixed.

(5) When a color is recorded all over a certain area, the color can be formed uniformly over the entire area.

(6) The ink discharging stability should be excellent (in particular, when a recording operation is stopped for a while, it is required that good stability should be obtained when a recording operation is re-started).

However, if conventional ink is used to form a color image on paper of the common type, bleeding occurs and it is difficult to obtain a high-quality image. One known method to avoid this problem is to use a special type of recording medium called "coated paper" a surface of which is coated with a material having high ability of absorbing ink.

In the case wherein a so-called common (a paper of common type) paper such as a copying paper or a bond paper is used, the recording operation should be performed in an intermittent manner so that an ink droplet is discharged after passage of a time long enough for a previous ink droplet to dry thereby suppressing the bleeding. However, this method has a disadvantage that the recording operation is slow.

One possible method to avoid the above problem of the bleeding without using additional means is to employ an ink which quickly penetrates into plain a common paper when attached to it. Paper is a porous material including a great number of capillaries and the penetration amount h of ink droplets attached to a paper can be represented by equation (1) shown below which is known as Lucas-Washburm's equation.

$$h^2=\gamma\cdot r\cdot\cos\theta\cdot t/2\eta \tag{1}$$

where $\gamma$ denotes the surface tension of the ink, $\eta$, the viscosity of the ink, r, the average radius of capillaries, $\theta$, the angle of contact between the ink and paper, and t, the time required for the ink to penetrate into the paper.

If the time required for an ink droplet to completely penetrate into a paper after attached to the paper is denoted $t_a$ and the penetration amount of ink is denoted by $h_a$, then the following equation (2) is obtained.

$$t_a=(2\eta/\gamma\cdot r\cdot\cos\theta)h_a^2 \tag{2}$$

Furthermore, if the dot area formed by one ink droplet attached to a paper is denoted by S, the effective number of capillaries of the paper per unit area is denoted by N, and the volume of one dot of ink is denoted by V, then $$V=\pi r^2 h_a NS \tag{3}$$

From equations (2) and (3), the following equation can be obtained:

$$t_a=2\eta V^2/(\gamma\pi^2 r^2 N^2 S^2\cos\theta)=k\cdot(\eta/\gamma\cos\theta)(V/S)^2 \tag{4}$$

where k is a constant depending on the paper used.

In equation (4), $\eta/(\gamma\cos\theta)$ is the term relating to ink (ink term) and $(V/S)^2$ is the term relating to a head (head term). To obtain a small ink penetration time, it is required that the above ink and head terms should be small enough.

To determine the conditions which can effectively reduce the ink term $\eta/(\gamma\cos\theta)$ in equation (4) and thus can improve color image quality recorded on paper of the common type, the inventors of the present invention have measured the critical surface tension which is defined as the surface tension obtained when the angle e of contact between the paper and the ink droplet meets the condition $\cos\theta=1$ or $\theta=0°$.

The critical surface tension has been determined using the Zisman plot of the contact angle $\theta$ measured for various kinds of liquids having different surface tensions dropped on paper.

FIG. 1 is a Zisman plot representing the wettability of various liquids dropped on the surface of paper of the common type.

The liquids used in the measurement include purified water, glycerin, hexanetriol, and triethylene glycol. Copying paper and bond paper, which are of the type most widely used, were employed as a commom paper.

From the plot shown in FIG. 1, it can be seen that the critical surface tension for the common paper is less than 35 dyne/cm or less. Therefore, if ink having a surface tension less than the critical surface tension determined above is employed, the ink will have extremely high wettability to the common paper and penetrate quickly into the paper. As a result, high-quality image with no bleeding will be formed.

The head term $(V/S)^2$ in equation (4) may be reduced by reducing a thickness of ink attached to paper. The reduction in a thickness of the ink can be achieved by reducing the size of an ink droplet and also increasing the discharge velocity of the ink droplet so that the ink droplet expand to a greater extent when it collides with the surface of the paper.

FIGS. 2 to 6 illustrate a process of discharging an ink droplet by means of thermal energy according to a conventional ink jet recording method.

FIG. 2 illustrates an initial state in which the liquid path 50 is filled with ink 53. A current (electrical signal) in the form of a pulse is instantaneously flowed through a heater (for example, an electro-thermal transducer) 51 thereby quickly heating a part of the ink 53 near the heater 51. As a result, so-called film boiling occurs and a great number of nuclei of small bubbles are generated in the ink 53 on the heater 51. The generated bubbles combine together into a single bubble and the resultant bubble starts quick expansion (FIG. 3). The bubble 52 continues to expand further and the ink 53 in the liquid path 50 is pushed out in both directions, that is, toward the discharge opening 54 and toward the ink supply opening (FIG. 4). Thus, a part of the ink 53*a* is discharged out via the discharge opening 54 at the end of the liquid path. At the time immediately after the discharging, the ink 53*a* still has a connection to the discharge opening 54 via a tail (FIG. 5).

The tail of the discharged ink 53*a* is cut off by the surface tension of the ink itself and also by the force which puts back the meniscus of the ink 53 formed at the surface of the discharge opening 54 of the liquid path 50. Thus, an ink particle 55 is formed and ejects toward a recording medium (not shown). When the pulse current flowing through the heater has been shut off and thus the bubble 52 has disappeared, the meniscus is drawn toward the inside of the discharge opening 54, and ink is supplied from the ink supply opening. As a result, the meniscus returns to the initial state via damping motion and thus discharge of another ink droplet becomes ready (FIG. 6).

In the case of an on-demand type recording head using a piezoelectric element, an ink droplet is discharged in a similar manner and motion of meniscus also occurs in a similar manner.

To suppress the bleeding, as described earlier, it is required that the surface tension of ink should be nearly equal to or less than the critical surface tension associated with recording medium on which an image is to be formed, and thus the ink used should have a very low surface tension.

However, in the conventional recording method of the on-demand type, if ink having a low surface tension is used, a tail is generated when an ink is discharged, and the tail is easily cut and divided into a great number of droplets so-called "satellite" extremely smaller than the main droplet. This problem remaining to be solved will be described in further detail below with reference to FIGS. 7 and 8.

FIG. 7 illustrates the discharge of ink having a surface tension of 48 dyne/cm, and FIG. 8 illustrates the discharge of ink having a surface tension of 28 dyne/cm. As can be seen from these figures, in the case of the lower the surface tension of ink, greater the number of satellite 66, satellite splashes 67, and mist (not shown) are generated.

Another problem which occurs when such ink having a low surface tension is used in a conventional recording method is that the damping time of the meniscus becomes too long and it becomes difficult to perform stable discharge of ink droplets.

Furthermore, if such the ink having a low surface tension is employed, the periphery of the discharge opening is likely to be wetted with ink and a great number of splashes and mist are generated.

SUMMARY OF THE INVENTION

It is an object of the present invention to provide an ink jet recording method and an ink jet apparatus which no longer have the problems described above.

According to one aspect of the invention, there is provided an ink jet recording method for recording in which an ink is discharged by the pressure of a bubble generated in the ink by means of thermal energy comprising the steps of: preparing an ink jet head having a liquid path provided with a heating element and communicated with a discharge opening, the liquid path; supplying ink into the liquid path, an ink having a surface tension less than or equal to the critical surface tension of a recording medium; generating thermal energy for generating a bubble with the heating element in such a manner that the bubble is communicated with the atmosphere from the discharge opening under the state where the generated bubble has a negative internal pressure; and discharging the ink from the discharge opening by means of the pressure of the bubble generaed, thereby recording the image.

According to another aspect of the invention, there is provided an ink jet recording apparatus for recording in which an ink is discharged by the pressure of a bubble generated in the ink by means of thermal enegy comprising: an ink jet head comprising a discharge opening and a liquid path provided with an electro-thermal transducer and communicated with the discharge opening as well as filled with an ink having a surface tension less than or equal to critical surface tension of recording medium on which an image is to be recorded; electric signal supplying means for supplying electric signal to the electro-thermal transducer so that the electro-thermal transducer generates thermal energy for generating a bubble in such a manner that the bubble is communicated with the atmosphere from the discharge opening under the state where the generated bubble has a negative internal pressure; and means for transferring a recording medium on which the ink discharged by the pressure of the bubble generated.

DESCRIPTION OF THE PREFERRED EMBODIMENTS

Referring to the accompanying drawings, preferred embodiments of the present invention will be described in detail below.

Figure 9:
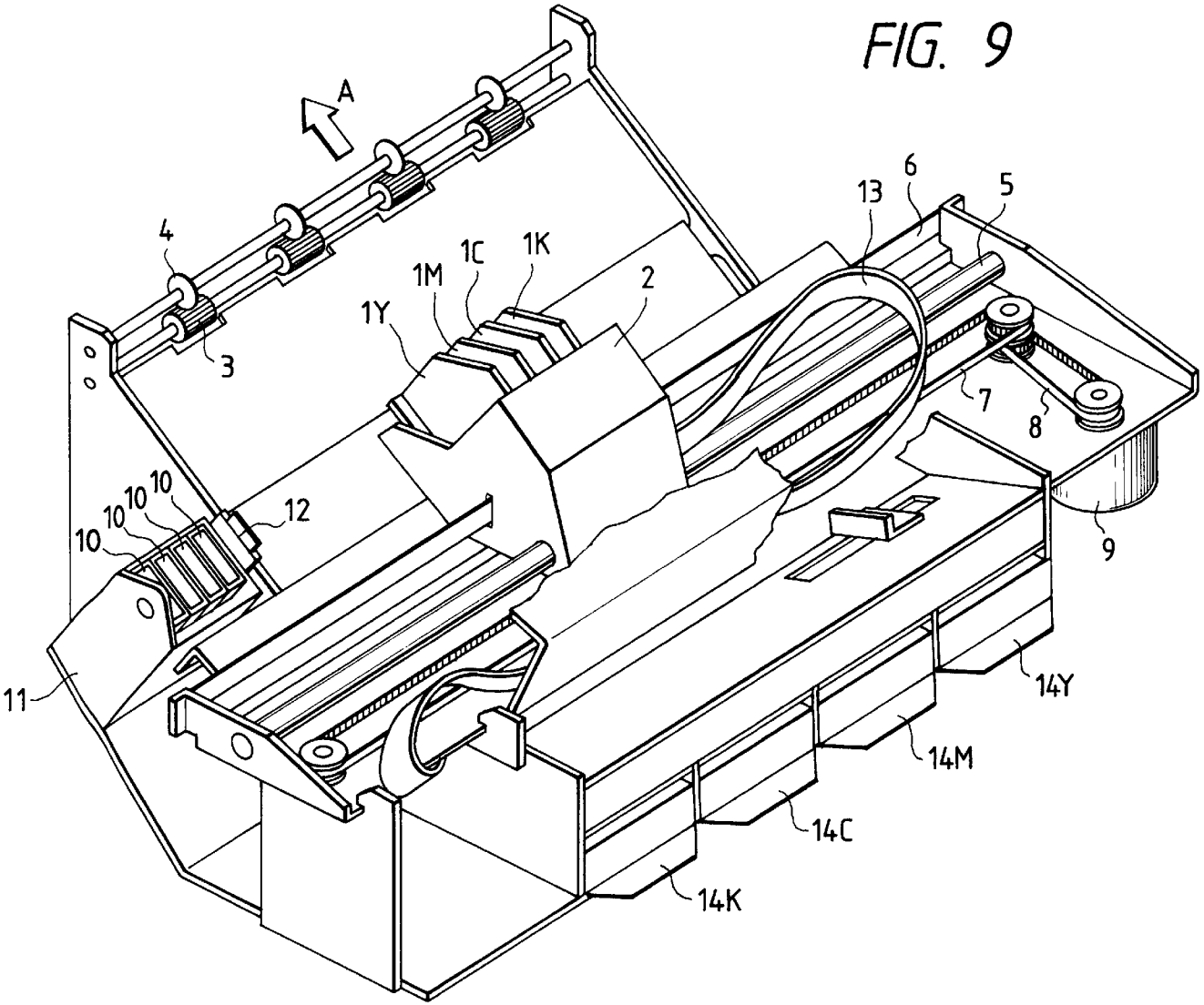
FIG. 9 is a perspective view of the main part of a color ink jet recording apparatus of the serial scanning type, according to an embodiment of the present invention.

FIG. 9 is a perspective view of the main part of a color ink jet recording apparatus of the serial scanning type, according to the present invention. As shown in FIG. 9, a print head 1Y for discharging a yellow ink, a print head 1M for discharging a magenta ink, a print head 1C for discharging a cyan ink, and a print head 1K for discharging a black ink are disposed in a carriage 2 in such a manner that these print heads are spaced from each other at predetermined intervals. A recording medium such as a paper or a thin plastic sheet is held between feed-out rollers 3 and 4 after being carried by a carrying roller (not shown). With the driving motion of a carrying motor (not shown), the recording medium is carried in the direction denoted by the arrow A.

The carriage 2 is supported and guided by a guide shaft 5 and an encoder 6.

The carriage 2 is driven by a carriage motor 9 via driving belts 7 and 8 so that the carriage moves along the guide shaft 5 in both directions.

A plurality of discharge openings are provided on the surface (surface formed discharge opening), facing the recording medium, of each recording heads 1Y, 1M, 1C, and 1K. In the inside of each discharge opening (liquid path) there is provided a heating element (electro-thermal transducer) for generating thermal energy thereby discharging an ink droplet.

In response to the reading timing of the encoder 6, the heating element is driven according to a recording signal so that droplets of black, cyan, magenta, and yellow ink are discharged one by one toward the surface of the recording medium. Thus the ink droplets are attached to the surface of the recording medium, thereby forming an image thereon.

At the home position of the carriage 2 in an area outside the recording area, there is disposed a recovery unit 11 having caps 10 which is able to perform an operation for recovering discharge.

There is also provided a cleaning blade 12 for cleaning the discharge opening surface of each print head.

Ink is supplied to print heads from corresponding ink tanks 14 via ink supply tubes 13 and via sub-tanks (not shown) disposed on the carriage 2.

FIGS. 10 to 14 illustrate the ink discharging method, i.e. the ink jet recording method for discharging an ink droplet having a low surface tension according to the present invention.

Figure 10:
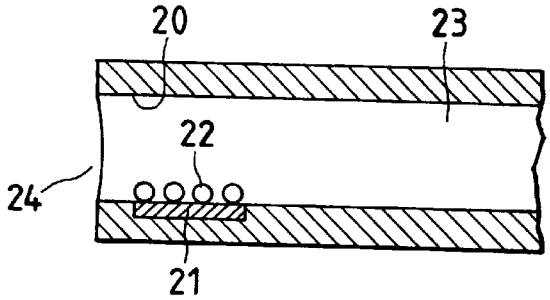
FIG. 10 is a schematic representation of the process of discharging an ink droplet according to an embodiment of the present invention.
Figure 11:
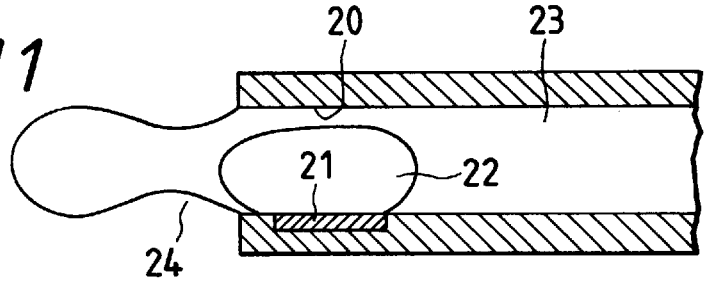
FIG. 11 is a schematic representation of the process of discharging an ink droplet according to the embodiment of the present invention.

FIG. 10 illustrates an initial state in which the liquid path 20 is filled with ink 23 having a surface tension lower than a recording medium. A current (pulse signal) is instantaneously flowed through a heating element (for example, electro-thermal transducer) 21 thereby quickly heating a part of the ink 23 near the heater 21. As a result, film boiling occurs and a great number of nuclei 22 of small bubbles are generated in the ink 23 on the heating element 21. The generated bubbles combine together into a single bubble and the resultant bubble starts quick expansion (FIG. 11). The bubble 22 continues to expand further and grows mainly toward the discharge opening 24 having a smaller inertial resistance. Finally, the bubble 22 goes out beyond the discharge opening 24 and thus the bubble 22 comes to communicate with the outside air. At this moment, the pressure in the bubble is negative and therefore the outside air flows into the bubble 22.

Figure 13:
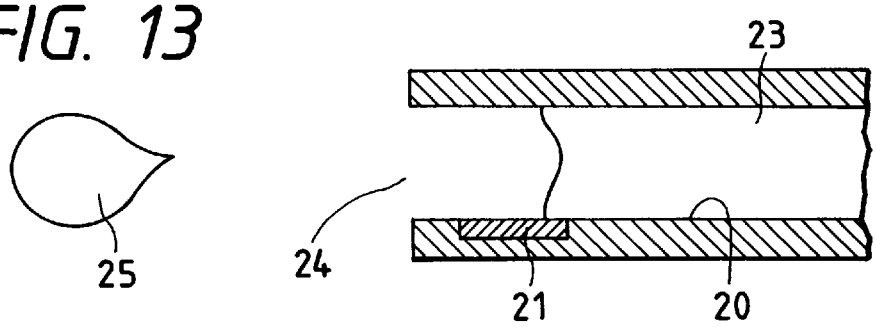
FIG. 13 is a schematic representation of the process of discharging an ink droplet according to the embodiment of the present invention.

The ink 23 pushed out from the discharge opening 24 has gained momentum by the expansion of the bubble 22 and thus further ejects in the forward direction. Finally, the ink 23 becomes a separate droplet 25 and ejects toward the recording medium (FIG. 13).

Figure 14:
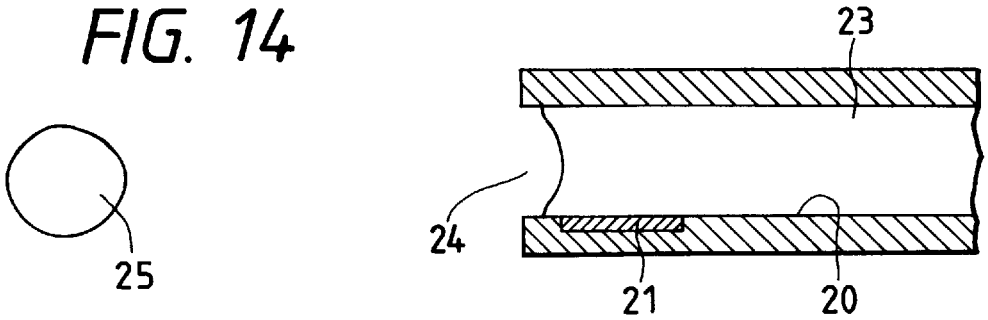
FIG. 14 is a schematic representation of the process of discharging an ink droplet according to the embodiment of the present invention.

As a result of the above process, a space is generated at the front end of liquid path near the discharge opening 24. The ink is supplied by the surface tension of the ink at the rear end and by the wetting of the ink to the material forming the liquid path 20, and as a result the space eventually disappears (FIG. 14). Thus, the process returns to the initial state.

Figure 12:
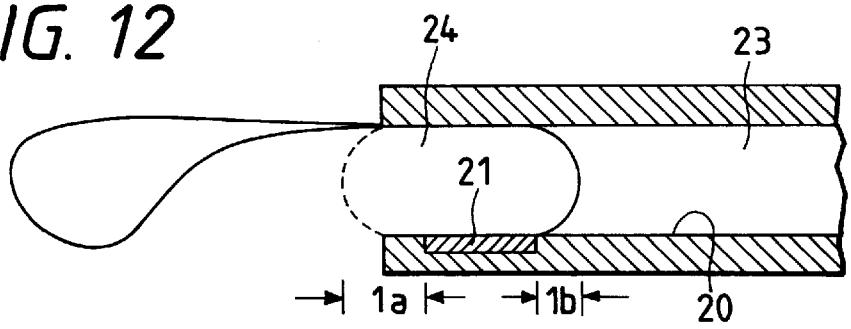
FIG. 12 is a schematic representation of the process of discharging an ink droplet according to the embodiment of the present invention.

As shown in FIG. 12, the bubble 22 preferably has an internal pressure lower than the atmospheric pressure at the moment when the bubble comes to communicate with the outside air so that the generation of satellite droplets is suppressed.

More preferably, the liquid path is not completely blocked at the growth stage of a bubble until the completion of discharging an ink droplet. In the present embodiment, these requirements are achieved by employing the structure described below. That is, as shown in FIG. 12, the distance from the center of the heater 21 to the discharge opening 24 is set to a value equal to or less than about half the size of a bubble 22, measured along the length of the liquid path when it is hypothesized that the bubble 22 becomes to the size to completely block the liquid path 20. As described above, the bubble 22 grows more greatly in the vicinity of the discharge opening 24 toward the discharge opening 24 than toward the opposite direction, and thus the bubble 22 has a slightly greater size in the region at the side of the heater 22 than in the opposite region when the heater 21 is made the center. That is, the length la shown in FIG. 12 is slightly greater than the length lb. These lengths la and lb are defined by estimating that a bubble 22 grows to a size which results in complete clogging the liquid path 20. In the actual structure, the distance between the front end of the heater 21 and the discharge opening 24 is set to a value equal to or less than the length la which is the length when the liquid path 20 would be completely clogged with the bubble 22. According to the construction, the liquid path 20 is not completely clogged during growth of a bubble until an ink droplet 25 is discharged. Since the liquid path is not completely clogged during growth of a bubble, this method provides an excellent properties in refilling the liquid path with ink which is to be ejected next. Furthermore, heat higher than 300° C. can be released outward with a droplet, and therefore this method also provides excellent frequency response.

As described above, according to the present method for discharging ink having a low surface tension wherein a bubble is communicated with the atmosphere, when a bubble is communicated with the atmosphere, the droplet is gradually separated while the liquid in the liquid path being communicating with the droplet ejected from the discharge opening. Therefore, generation of splash can be prevented.

Furthermore, foaming, vibration during ink refilling and tailing of ink due to the meniscus recovery force are minimized. As a result, it is possible to prevent the generation of satellite droplets which is a problem in a conventional method.

In the method for discharging ink according to the present invention, a bubble is preferably formed under the conditions described below.

A first condition is that a bubble is communicated with the ambient air under the conditions in which an internal pressure of the bubble is less than the atmospheric pressure.

That is, if a bubble has an internal pressure less than the atmospheric pressure at the moment when the bubble comes to communicate with the ambient air, it is possible to prevent ejection of unstable droplets in the vicinity of the discharge opening, which would occur if the bubble has an internal pressure greater than the atmospheric pressure at the moment when the bubble comes to communicate with the ambient air. Furthermore, if the internal pressure of a bubble is less than the atmospheric pressure, a force, although not strong, acts on the unstable droplet so that it is drawn toward the inside of the liquid path, and thus it is possible to achieve a stable discharge of liquid and to prevent ejection of unnecessary liquid.

In addition to the first condition described above, it is more desirable that a bubble comes to communicate with the ambient air while also satisfying a second condition and/or third condition described below. That is, the second condition is that the bubble is communicated with the ambient air under the state where bubble has a negative value in a first order differential of the moving velocity at the moment. The third condition is that $la/lb \geqq 1$ where la is the distance between the end face of a bubble at the side end of the discharge opening and the end of discharging energy generating means (heating element) as the side end of the discharge opening and lb is the distance between the other end face of the bubble at the opposite side end of the discharge opening and the other end of discharging energy generating means (heating element) at the opposite side end of the discharge opening.

Table 1 illustrates the composition of ink used in this embodiment.

TABLE 1

| COMPOSITION OF INK | |
|---|---|
| Dye | See Table 2 |
| Glycerin | 7.5 parts |
| Thiodiglycol | 7.5 parts |
| Acetylene glycol added with ethylene oxide (m + n = 10) | 5 parts |
| Urea | 7.5 parts |
| Purified water | Balance |

Figure 1:
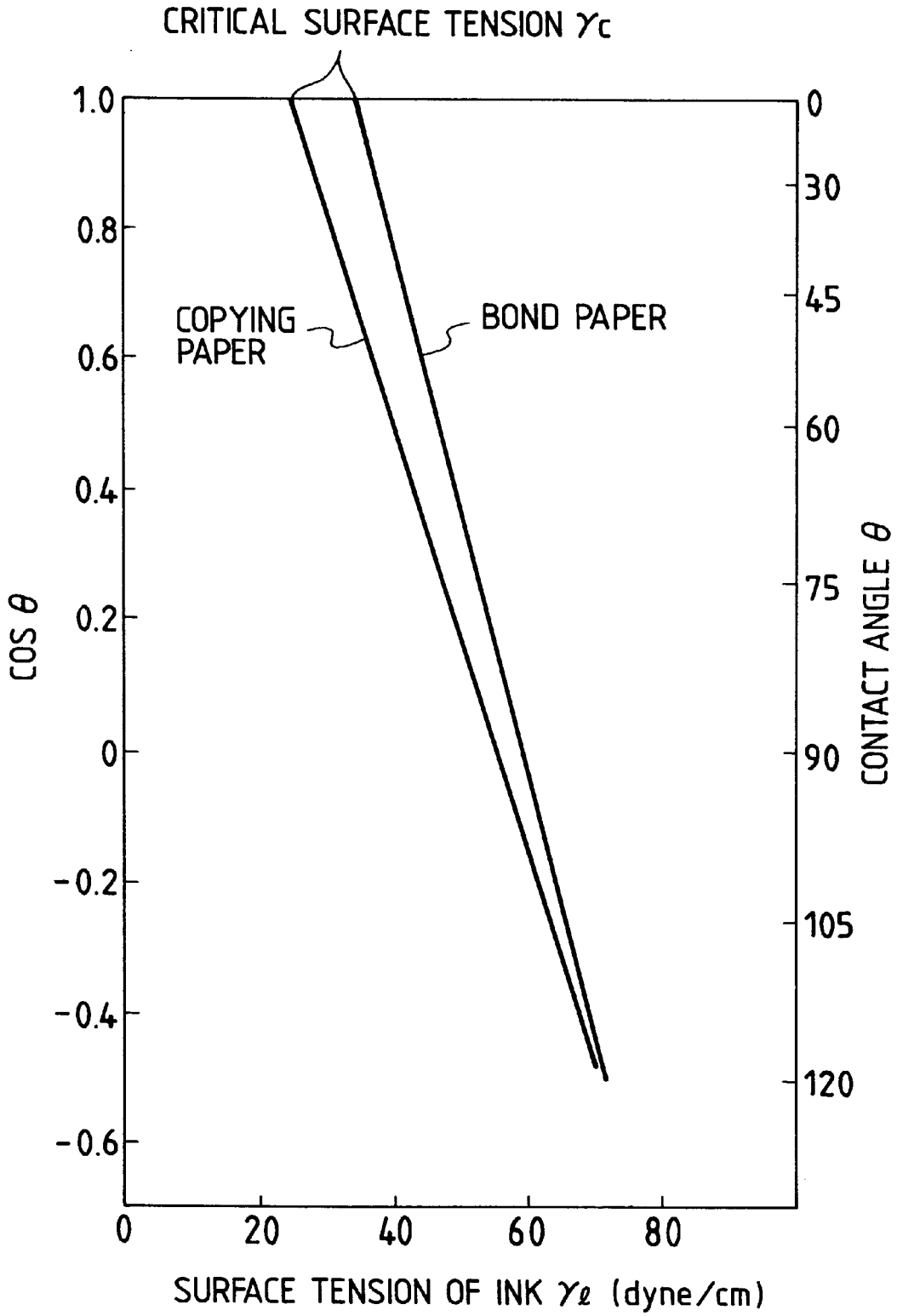
FIG. 1 is a graph illustrating the critical surface tension associated with a recording medium.
Figure 2:
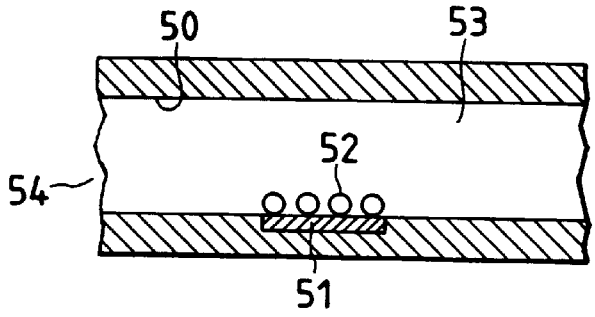
FIG. 2 PRIOR ART
FIG. 2 is a schematic representation of the process of discharging an ink droplet according to a conventional method.
Figure 3:
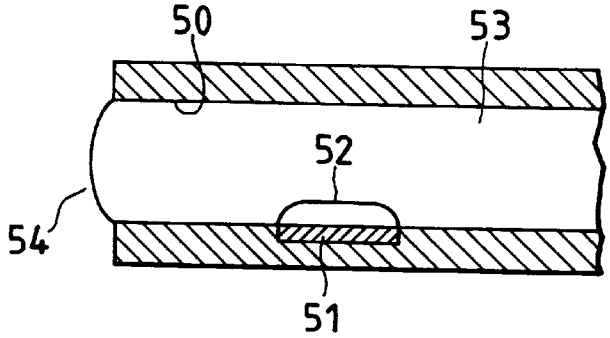
FIG. 3 PRIOR ART
FIG. 3 is a schematic representation of the process of discharging an ink droplet according to the conventional method.
Figure 4:
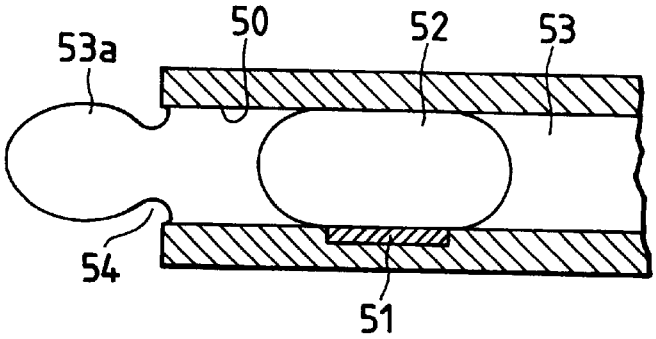
FIG. 4 PRIOR ART
FIG. 4 is a schematic representation of the process of discharging an ink droplet according to the conventional method.
Figure 5:
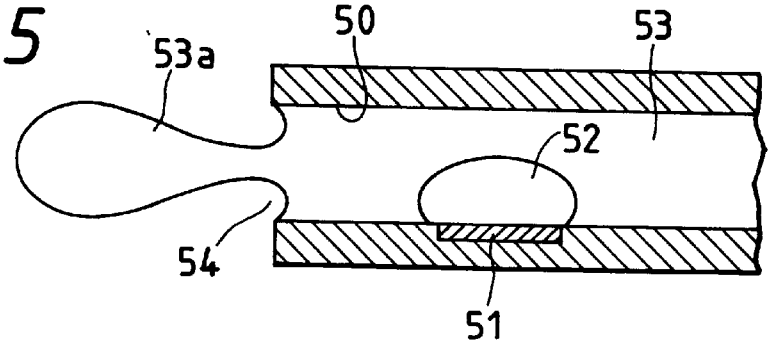
FIG. 5 PRIOR ART
FIG. 5 is a schematic representation of the process of discharging an ink droplet according to the conventional method.
Figure 6:
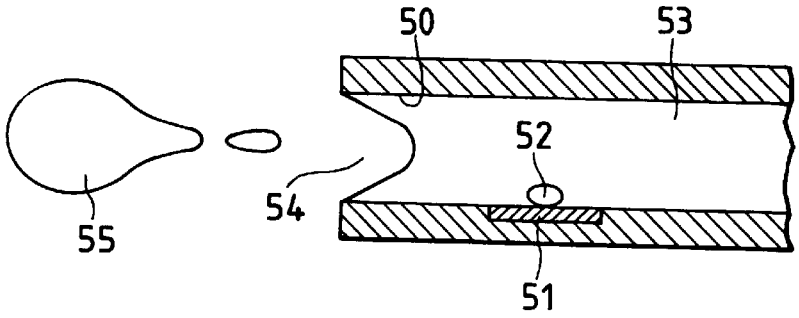
FIG. 6 PRIOR ART
FIG. 6 is a schematic representation of the process of discharging an ink droplet according to the conventional method.
Figure 7:
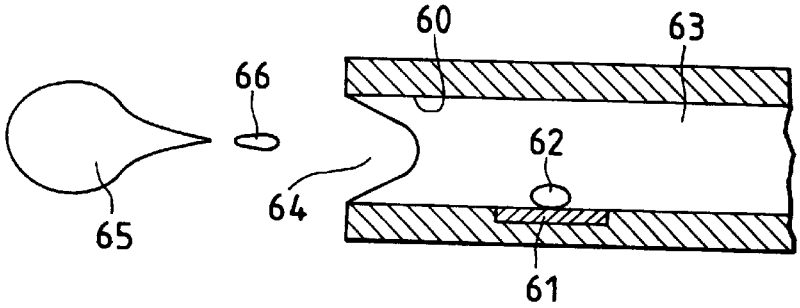
FIG. 7 PRIOR ART
FIG. 7 is a schematic representation of a droplet of conventional ink discharged by the conventional method.
Figure 8:
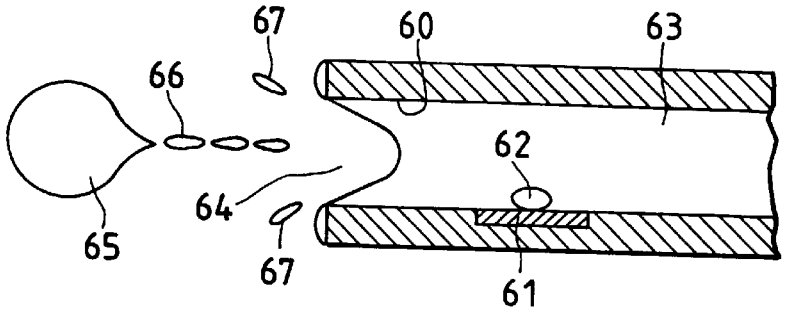
FIG. 8 PRIOR ART
FIG. 8 is a schematic representation of a droplet of ink having a low surface tension discharged by the conventional method.

The dye concentrations for the respective colors are shown in Table 2. Table 3 illustrates the composition of conventional ink taken here for comparison with the ink according to the invention. The ink used in the present embodiment has a surface tension $\gamma$ of 27.8 dyne/cm and a viscosity $\eta$ of 1.49 cp. As can be seen from a comparison with FIG. 1, the surface tension of this ink is less than the critical surface tension (35 dyne/cm) of the common paper and therefore this ink shows extremely good wettability and can penetrate very quickly into paper.

On the other hand, the conventional ink has a surface tension $\gamma$ of 48 dyne/cm and a viscosity $\eta$ of 2.0 cp. As can be seen from FIG. 1, the surface tension of the conventional ink is greater than the critical surface tension (35 dyne/cm) to the common paper and thus the conventional ink shows poor wettability, and penetrates slowly into the paper. As a result, the conventional ink easily generates bleeding.

TABLE 2

| DYE CONTENT | | |
|---|---|---|
| Black | C. I. food black 2 | 4 parts |
| | (Dye A) | (2.4 parts) |
| | (Dye B) | (1.6 parts) |
| Yellow | C. I. direct yellow 86 | 2.5 parts |
| Magenta | Dye C | 3.5 parts |
| Cyan | C. I. direct blue 199 | 3.5 parts |

Dye A

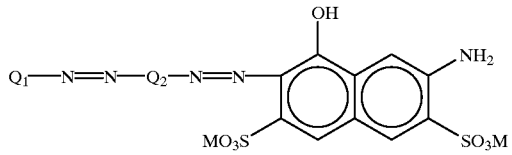

Dye B

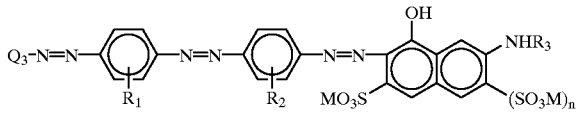

where Q1 is lower alkyl carbonyl amino group- or lower alkoxy group-substituted phenyl group or naphthyl group, or $SO_3M$ group-substituted naphthyl group, Q2 is $SO_3M$ group-substituted naphthyl group or lower alkoxy group-substituted phenyl group, Q3 is $SO_3M$ group-substituted or unsubstituted phenyl group or naphthyl group, R1 and R2 are a group selected from lower alkyl group, lower alkoxy group, and lower alkyl carbonyl amino group, R3 is hydrogen- or $SO_3M$ group-substituted phenyl group, M is alkali metal or ammonium, and n denotes 0 or 1.

Dye C

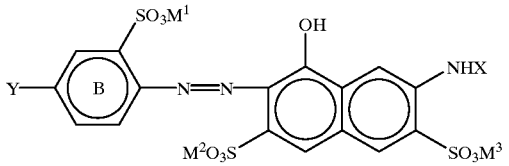

where Y is a hydrogen atom, methyl group, methoxy group, acetyl amino group, or nitro group, wherein Y may form a benzene ring together with a third-order carbon atom of the benzene ring B, X is acetyl group, benzoyl group, p-toluenesulfonyl group, or 4-chloro-6-hydroxy-1,3,5-triazine-2-yl group, $M^1$,$M^2$ and $M^3$ are a base selected from alkali metal, ammonium and amine, respectively.

TABLE 3

| COMPOSITION OF CONVENTIONAL INK | |
|---|---|
| Dye | See Table 2 |
| Glycerin | 7.5 parts |
| Thiodiglycol | 7.5 parts |
| Urea | 7.5 parts |
| Purified water | Balance |

Penetrating agents which may be employed in the present invention include anionic surface-active agent such as aerosol of the OT type, sodium dodecylbenzenesulfonate, or sodium lauryl sulfate ether and nonionic surface active agent such as compounds represented by chemical formula 1 shown below which can be obtained by adding ethylene oxide to higher alcohol; compounds represented by chemical formula 2 shown below which can be obtained by adding ethylene oxide to alkylphenol; ethylene oxide-propylene oxide copolymers represented by chemical formula 3 shown below; or compounds represented by chemical formula 4 shown below which can be obtained by adding ethylene oxide to acetylene glycol.

The anionic surface-active agents described above have strong frothing property and is not convenient for handling. Therefore, nonionic surface active agents represented by chemical formulas 1 to 4 are employed in this embodiment.

In the compounds represented by general formulas 1 and 2, it is desirable that n be in the range from 6 to 14.

Furthermore, it is desirable that R contain 5 to 26 carbon atoms. In the case of the compounds represented by chemical formulas 3 and 4, it is desirable that m+n be in the range from 6 to 14.

Chemical formula 1

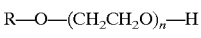

where R is an alkyl group.

Chemical formula 2

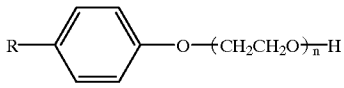

where R is an alkyl group.

Chemical formula 3

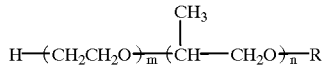

where R is hydrogen or an alkyl group.

Chemical formula 4

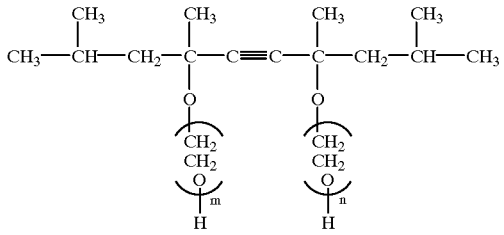

where m and n are an integer.

Of the nonionic surface active agents of the ethylene oxide type described above, a compound obtained by adding ethylene oxide to acetylene glycol is excellent in various characteristics such as image quality formed on a recording medium, discharging properties from a recording head, and the like. The hydrophilic nature and permeability of this compound can be controlled by adjusting the number m+n of the added ethylene oxide. If the number m+n is less than 6, the compound exhibits poor water-solubility and thus poor solubility into ink, although the compound shows good permeability.

On the contrary, in the case where the addition number of ethylene oxide is too large, the permeability lowers although hydrophilic nature increases. If m+n is larger than 14, a great amount of compound is required to be added in order to obtain effective permeability, and a problem will occur in ejecting an ink droplet. Thus, it is desirable that the addition number of ethylene oxide be in the range from 6 to 14.

The amount of the nonionic surface active agent added to ink is preferably in the range from 0.1 to 20 wt %. If the addition amount is less than 0.1 wt %, the permeability is not good enough and thus good image quality cannot be obtained. If the addition amount is greater than 20 wt %, the effects obtained become saturated, and higher cost is required, and furthermore the reliability of ink becomes poor.

One type of nonionic surface active agent may be employed, or otherwise a mixture of a plurality of nonionic surface active agents may be used.

As required, the ink may be added with a further agent such as a dye serving as a recording agent, a low-volatile organic solvent such as polyhydric alcohol serving to prevent the liquid path from being clogged, or an organic solvent such as alcohol for improving the stability of bubble formation and fixing property of ink on a recording medium.

Water-soluble organic solvents, which may be employed to constitute an ink of the invention, include: polyalkylene glycol such as polyethylene glycol or polypropylene glycol; alkylene glycol whose alkylene group contains 2 to 6 carbon atoms such as ethylene glycol, propylene glycol, butylene glycol, triethylene glycol, 1•2•6-hexanetriol, hexylene glycol, or diethylene glycol; glycerin; lower alkyl ether of polyhydric alcohol such as, ethylene glycol methyl ether, diethylene glycol methyl (or ethyl) ether, or triethylene glycol monomethyl (or ethyl) ether; alcohol such as methyl alcohol, ethyl alcohol, n-propyl alcohol, isopropyl alcohol, n-butyl alcohol, sec-butyl alcohol, tert-butyl alcohol, isobutyl alcohol, benzyl alcohol, or cyclohexanol; amide such as dimethylformamide or dimethylacetamide; ketone or ketone alcohol such as acetone or diacetone alcohol; ether such as tetrahydrofuran or dioxane; and cyclic nitrogen compound such as N-methyl-2-pyrolidone, 2-pyrolidone, or 1•3-dimethyl-2-imidazolidinone.

The amount of the water-soluble organic solvent added in the ink is preferably within the range which does not deteriorate image quality and discharge reliability. Preferably, 1 to 30 wt % polyhydric alcohol or alkyl ether of polyhydric alcohol is added in the ink.

The ink of the present invention preferably contains 50 to 90 wt % purified water.

Dyes which may be employed in the present invention include direct dye, acid dye, basic dye, reactive dye, disperse dye, and vat dye. The amount of the dye contained in the ink is preferably in the range from 0.5 to 15 wt % relative to the total weight of the ink, and more preferably in the range from 1 to 7 wt %, although the particular amount of the dye depends on composition of the liquid medium, the required characteristics of the ink, and the discharge amount of a recording head.

Furthermore, if thiodiglycol or urea (or its derivative) is added to the ink, it is possible to greatly improve the discharge properties and also the ability of preventing the liquid path from being clogged or sealed. This is due to the fact that their addition results in improvement of the solubility of the dye into the ink. The amount of thiodiglycol or urea (or its derivative) is preferably in the range from 1 to 30 wt % although the specific amount is determined as required.

In addition to the above-described main ingredients of the ink, the ink of the invention may also contain other ingredients, for example, viscosity modifier such as polyvinyl alcohol, cellulose, or water-soluble resin; pH adjustor such as diethanolamine, triethanolamine, or buffer solution; or mildewcide although the agents should be added so that the purposes of the invention are not obstructed by these agents.

The recording according to the embodiment in which the bubble is communicated with the ambient air, using the ink having a low surface tension and the ink having a high surface tension is conducted and the result is mentioned below.

As for the length of a bubble generated (bubble length), the ink having low surface tension according to the present embodiment of the invention showed a longer bubble length.

This is because the ink of the present embodiment mainly employs a surface active agent as a penetrating agent and thus the surface of the heater has good wettability which results in stable film boiling, which is important to discharge ink. As a result, the ink of the present embodiment can provide a preferable bubbling condition for the discharging method in which ink is descharged by communicating the bubble with the ambient air. That is, since a bubble having a large size is generated in the ink, the bubble can communicate with the ambient air even if the heater is located far from the discharge opening, and thus it is possible to discharge a large amount of ink droplet. Furthermore, it is possible to generate a bubble having an enough size using a heater ever with a small area, and therefore it is possible to make the heater area small and to reduce the power consumption.

The generation of satellite, which is a serious problem in the conventional method using an ink having a low surface tension, is suppressed to a very low level. Since neither splashes nor satellites are generated, the periphery of a nozzle is not wetted with ink and thus intervals of discharge recovery operations which should be performed periodically was lengthened and obtained good discharge.

Furthermore, when the liquid path is not completely clogged during the bubble growth, the vibration of the meniscus is small and thus the damping time of the meniscus becomes very short.

Figure 15:
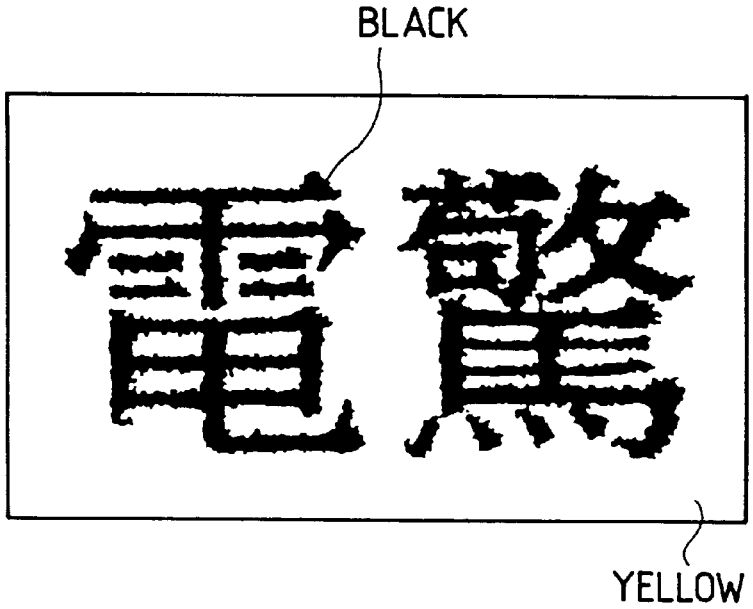
FIG. 15 illustrates an example of an image formed with an ink according to an embodiment of the present invention.
Figure 16:
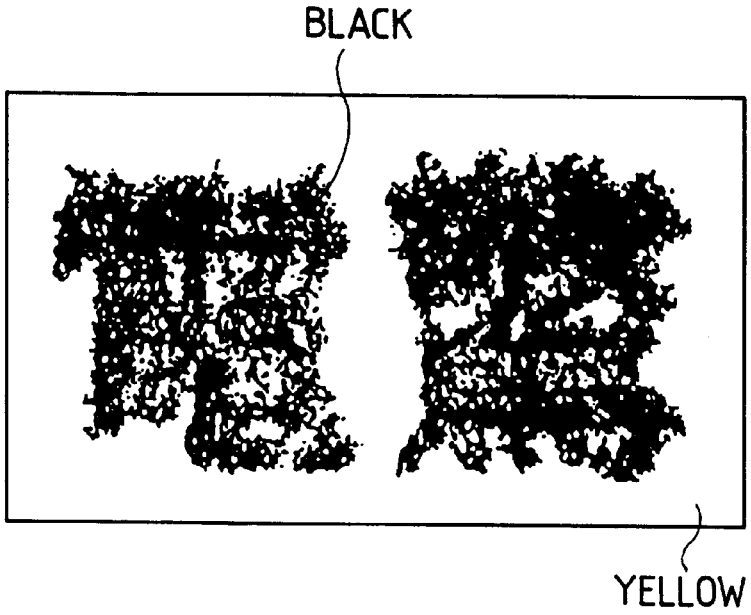
FIG. 16 PRIOR ART
FIG. 16 illustrates an example of an image formed with a conventional ink.

FIGS. 15 and 16 illustrate examples of recorded images. FIG. 15 illustrates an image formed with an ink having a composition according to the present embodiment of the invention, and FIG. 16 illustrates an image formed with an ink having a conventional composition.

The characters were formed with a black ink and the background was formed with a yellow ink. As can be seen from these figures, the image formed with the ink according to the present embodiment provided higher quality having less deterioration caused by bleeding than that formed with the conventional ink.

Other Embodiment

Table 4 illustrates the composition of an ink according to another embodiment of the invention. The dye contents of each color are shown in Table 2.

The ink used in the present embodiment has a surface tension of 32 dyne/cm and a viscosity η of 2.0 cp. Similarly to the case of the ink according to the previous embodiment described above, the surface tension of this ink is less than the critical surface tension (35 dyne/cm) to the common paper and therefore this ink shows extremely good wettability and can penetrate very quickly into paper.

TABLE 4

| Composition of ink | |
|---|---|
| Dye | See Table 2 |
| Glycerin | 7.5 parts |
| Thiodiglycol | 7.5 parts |
| Cyclohexanol | 3 parts |
| Urea | 7.5 parts |
| Purified water | Balance |

In this embodiment, the ink does not contain a surface active agent serving as a penetrating agent. Instead, the permeability required of the ink is obtained by adjusting the amount of the added alcohol such as methyl alcohol, ethyl alcohol, n-propyl alcohol, isopropyl alcohol, n-butyl alcohol, sec-butyl alcohol, tert-butyl alcohol, isobutyl alcohol, benzyl alcohol, or cyclohexanol.

To obtain a desired ink having a surface tension of 35 dyne/cm, it is preferable that the amount of the alcohol added in the ink be in the range from 3 to 30 wt %.

The ink discharging method used in this embodiment is similar to that employed in the previous embodiment and thus it is not described here again.

The ink of the present embodiment has been evaluated as in the previous embodiment.

As for the length of a bubble generated (bubble length) at the time of ink discharge, the ink of the present embodiment showed a longer bubble length than that of the conventional ink shown in Table 3.

This is because the ink of the present embodiment contains alcohol serving as a penetrating agent and thus has a high vapor pressure as well as a high boiling point which makes the film boiling easier. As a result, the ink of the present embodiment can provide a preferable bubbling condition which matches well the ink discharging method of the invention.

Furthermore, the generation of satellite, which is a serious problem in the conventional method using an ink having a low surface tension, is suppressed to a very low level. Since neither splashes nor satellites are generated, the periphery of a nozzle is not wetted with ink and thus intervals of discharge recovery operations which should be performed periodically was lengthened and obtained good discharge. Furthermore, since the liquid path is not completely clogged during the bubble growth, the vibration of the meniscus is small and thus the meniscus is stabilized for a very short time.

Similar to the previous embodiment, the ink of the present embodiment provided a high-quality image having little deterioration caused by bleeding.

According to the present invention, as described above, a surface active agent or alcohol is added to an ink to obtain a low surface tension. This makes it possible to form a high-quality image on common paper without deterioration in the image quality caused by bleeding and an excellent image can be formed.

Furthermore, according to the present invention, it is possible to generate a bubble having a greater size than the conventional ink.

In the method of discharging an ink, it is required that the distance between the heater and the discharge opening should be small enough so that a bubble generated near the discharge opening is communicated with the ambient air (FIG. 12). However, if the ink of the present embodiment is employed, it is possible to generate a bubble having a long size and thus it becomes possible to lengthen the distance between the heater and the discharge opening. This makes it easy to obtain high accuracy in the processing of the head, and to obtain stability of ink discharging.

Furthermore, according to the ink discharging method of the present embodiment, the generation of satelite dot is prevented, discharge defect by wetting a vicinity of nozzle caused by splash or satelite is prevented, damping time of meniscus shortened and stable discharging of ink is obtained.

Furthermore, according to the ink jet recording method and the ink jet recording apparatus according to the present invention, offers a combination of effects as will be described below.

Heretofore, when the method for discharging ink in which a bubble is communicated with the atmosphere is employed in order that the bubble generated in the vicinity of the discharge opening is communicated with the atmosphere, it is required that the distance between the heater and the discharge opening should be short, as mentioned above (FIG. 12). Therefore, when a conventional ink having a high surface tension which generates a bubble with a short size is employed, since the distance between the discharge opening and the heater is short, the amount of ink discharged at a time becomes small, and it is needed to perform a plurality of printing operations for the same pixel by scanning the carriage a plurality of times so as to attach an enough amount of ink on paper thereby obtaining a required image intensity.

However, if the ink having a low surface tension, as explained in the embodiment is employed in the ink discharging method in which a bubble comes to communicate with the atmosphere at the moment when an ink droplet is discharged, a bubble having a greater length can be generated and therefore it is possible to employ a longer distance between the heater and the emission opening, and thus it is possible to discharge a greater amount of ink droplet.

As a result, a plurality of printing operations for the same pixel are no longer required, and the printing speed is improved. Furthermore, since a less amount of ink returns into the liquid path from the side of the discharge opening and the meniscus vibration ceases in a very short time, a high speed driving can be achieved and printing speed is improved.

Furthermore, the greater length of the bubble compared to that obtained in the conventional ink leads to an improvement in the thermal efficiency and therefore it becomes possible to employ a smaller-sized heater in the ink discharging method in which a bubble comes to communicate with the atmosphere when an ink droplet is emitted. This allows a reduction in the power consumption and alleviates the problem caused by heat storage.

Furthermore, since it is possible to employ a longer distance between the heater and the discharge opening than in the case where the conventional ink is used, it becomes possible to have a greater dimensional tolerance in the production of an ink jet head. This allows an improvement in productivity.

Furthermore, the variation in the amount of an ink discharged can be reduced.

What is claimed is:

1. An ink jet recording method for recording in which an ink is discharged by a pressure of a bubble generated in the ink by means of thermal energy, comprising the steps of:

providing an ink jet head having a liquid path provided with a heating element and communicated with a discharge opening, the head causing an ink discharge without said bubble communicating with an atmosphere when the ink has a high surface tension;

providing a recording medium having a critical surface tension, the critical surface tension being defined such that a contact angle between the recording medium and a droplet of the ink is 0°;

generating thermal energy using the heating element for generating the bubble;

supplying the ink into the liquid path, and the ink has a surface tension less than or equal to the critical surface tension of the recording medium such that the bubble communicates with the atmosphere from the discharge opening; and discharging the ink from the discharge opening toward the recording medium by means of the pressure of the bubble generated with the bubble communicated with the atmosphere.

2. The ink jet recording method according to claim 1, wherein in the step of supplying the ink into the liquid path, the supplied ink has a surface tension less than or equal to 35 dyne/cm.

3. An ink jet recording apparatus for recording in which an ink is discharged by a pressure of a bubble generated in the ink by mans of thermal energy, comprising:

means for transferring a recording medium onto which the ink discharged by the pressure of the bubble generated is received, the recording medium having a critical surface tension, the critical surface tension being defined as such that a contact angle between the recording medium and a droplet of the ink is 0°;

an ink jet head comprising a discharge opening, and causing an ink discharge without said bubble communicating with an atmosphere when the ink has a high surface tension;

a liquid path provided with an electro-thermal transducer and communicated with the discharge opening and filled with the ink, and the ink has a surface tension less than or equal to the critical surface tension of the recording medium such that the bubble communicates with the atmosphere from the discharge opening under a state where the generated bubble has a negative pressure; and electric signal supplying means for supplying an electric signal for generating said bubble for discharging the ink while communicating with the atmosphere through said discharge opening, to the electro-thermal transducer.

4. The ink jet recording apparatus according to claim 3, wherein the ink supplied into the liquid path has a surface tension less than or equal to 35 dyne/cm.

* * * * *

UNITED STATES PATENT AND TRADEMARK OFFICE

CERTIFICATE OF CORRECTION

PATENT NO. : 6,065,827
DATED : May 23, 2000
INVENTOR(S) : Yuji Akiyama et al.

It is certified that error appears in the above-identified patent and that said Letters Patent is hereby corrected as shown below:

ON THE TITLE PAGE:

[56] References Cited, under U.S. PATENT DOCUMENTS
Insert: --5,218,376 6/1993 Asai--; and Under FOREIGN PATENT DOCUMENTS "361141585" should read --61-141585--; and
"402055184" should read --2-55184--.

Column 2:
Line 11, "a" should be deleted; and
Line 24, "after" should read --after being--; and
"denoted" should read --denoted by--.

Column 3:
Line 62, "the" (second occurrence) should be deleted.

Column 4:
Line 3, "the" should be deleted;
Line 6, "are" should read --is--; and
Line 26, "generaed," should read --generated,--.

Column 7:
Line 7, "properties" should read --property--; and
Line 17, "being" should read --is--.

Column 9:
Line 44, "is" should read --are--.

UNITED STATES PATENT AND TRADEMARK OFFICE

CERTIFICATE OF CORRECTION

PATENT NO. : 6,065,827
DATED : May 23, 2000
INVENTOR(S) : Yuji Akiyama et al.

It is certified that error appears in the above-identified patent and that said Letters Patent is hereby corrected as shown below:

Column 11:
Line 56, "descharged" should read --discharged--;
Line 61, "droplet." should read --droplets.--;
Line 62, "an" should be deleted; and
Line 63, "ever" should read --even--.

Column 12:
Line 5, "was" should read --were--.

Column 13:
Line 39, "according to" should be deleted;
Line 41, "invention, offers" should read --invention offer--;
Line 55, "an enough" should read --a sufficient--; and
Line 65, "droplet." should read --droplets.--.

Column 14:
Line 1, "less" should read --smaller--; and
Line 53, "mans" should read --means--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*